United States Patent [19]

Kanno et al.

[11] Patent Number: 5,044,343

[45] Date of Patent: Sep. 3, 1991

[54] SYSTEM AND METHOD FOR CONTROLLING FUEL SUPPLY TO AN INTERNAL COMBUSTION ENGINE

[75] Inventors: Yoshiaki Kanno; Jiro Sumitani, both of Himeji, Japan

[73] Assignee: Mitsubishi Denki K.K., Tokyo, Japan

[21] Appl. No.: 390,009

[22] Filed: Aug. 7, 1989

[30] Foreign Application Priority Data

Aug. 9, 1988 [JP] Japan ..... 63-199137

[51] Int. Cl.[5] ..... F02D 41/12

[52] U.S. Cl. ..... 123/493

[58] Field of Search ..... 123/492, 493

[56] References Cited

U.S. PATENT DOCUMENTS 4,424,568 1/1984 Nishimura et al. ..... 123/493 X 4,630,206 12/1986 Amamo et al. ..... 123/493 X 4,790,282 12/1988 Kanno et al. ..... 123/493

*Primary Examiner*—Tony M. Argenbright

*Attorney, Agent, or Firm*—Sughrue, Mion, Zinn, Macpeak & Seas

[57] ABSTRACT

A system and a method for controlling fuel supply to an internal combustion engine are disclosed in which excessive supply of fuel to the engine is effectively prevented in a most reliable manner particularly at the time of engine deceleration. To this end, a reduction in the amount of intake air sucked into an engine per intake stroke is sensed, and the amount of fuel supplied to the engine is reduced when there is a reduction in the intake air amount sucked into engine per intake stroke. The amount of reduction in the fuel supply is changed in accordance with at least one of the number of revolutions per minute of the engine and the amount of intake air sucked into the engine per intake stroke.

5 Claims, 8 Drawing Sheets

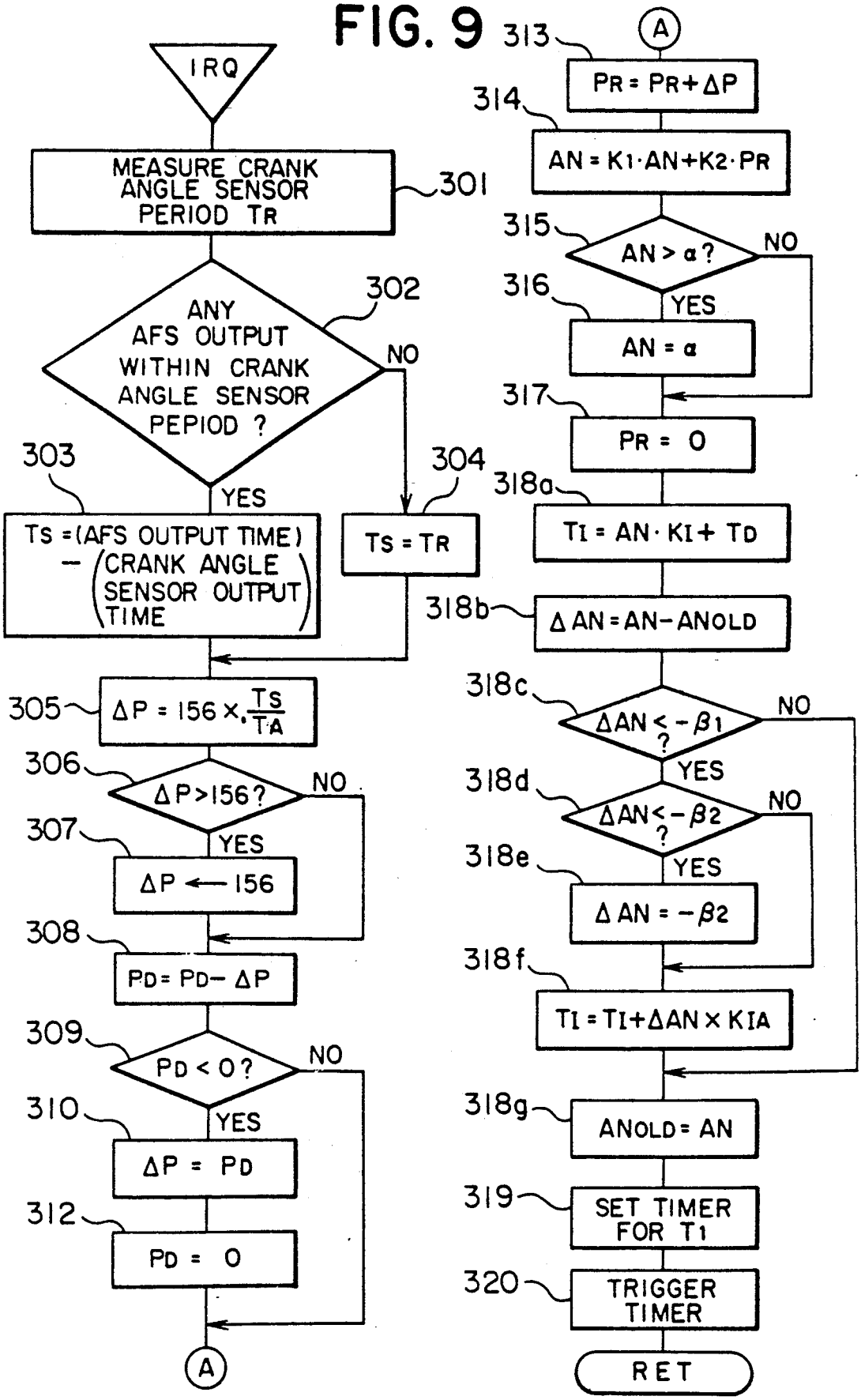
FIG. 9
IRQ
MEASURE CRANK ANGLE SENSOR PERIOD TR
301
ANY AFS OUTPUT WITHIN CRANK ANGLE SENSOR PEPIOD ?
302
NO
YES
303
Ts =(AFS OUTPUT TIME) − (CRANK ANGLE SENSOR OUTPUT TIME)
304
Ts = TR
305
ΔP = 156 × Ts/TA
306
ΔP>156?
NO
YES
307
ΔP ← 156
308
PD= PD− ΔP
309
PD < 0?
NO
YES
310
ΔP = PD
312
PD = 0
A
A
313
PR = PR+ΔP
314
AN = K1·AN+K2·PR
315
AN > α?
NO
YES
316
AN = α
317
PR = 0
318a
TI = AN · KI + TD
318b
ΔAN=AN−ANOLD
318c
ΔAN < −β1 ?
NO
YES
318d
ΔAN < −β2 ?
NO
YES
318e
ΔAN = −β2
318f
TI = TI+ΔAN × KIA
318g
ANOLD= AN
319
SET TIMER FOR T1
320
TRIGGER TIMER
RET

SYSTEM AND METHOD FOR CONTROLLING FUEL SUPPLY TO AN INTERNAL COMBUSTION ENGINE

BACKGROUND OF THE INVENTION

1. Field of the Invention

This invention relates to a system and a method for controlling the fuel supply to an internal combustion engine in which the amount of fuel supplied to an internal combustion engine is controlled by the output of an intake air sensor which operates to sense the amount of intake air sucked into the engine per intake stroke.

2. Description of the Related Art

Conventionally, fuel supply to an internal combustion engine is controlled based on the amount of intake air sucked into the engine per intake stroke which is calculated from the output of an intake air sensor (hereinafter abbreviated as AFS), which is disposed in an intake pipe at a location upstream of a throttle valve, as well as from the number of revolutions per minute of the engine.

In the case where an AFS is disposed in an intake pipe upstream of a throttle valve for sensing the amount of intake air sucked into an engine cylinder, the AFS measures, in addition to the amount of intake air actually sucked into the engine cylinder, the amount of intake air which is to be filled into a portion of the intake pipe between the throttle valve and the engine cylinder when the throttle valve is rapidly opened. Therefore, the AFS senses an amount of intake air greater than that actually sucked into the engine cylinder so that if fuel supply is controlled based on the output of the AFS, an air and fuel mixture supplied to the engine cylinder tends to become overrich.

In order to avoid such a situation, it was proposed to control the fuel supply by using the amount of intake air AN(n) sucked into the engine cylinder during the nth intake stroke (i.e., during the period between the nth and (n−1)th predetermined crank angle). In this case, $AN_{(n)}$ is determined by the following equation:

$$AN_{(n)}=K_1\times AN_{(n-1)}+K_2\times AN_{(t)}$$

where $AN_{(n-1)}$ is the amount of intake air sucked into the engine cylinder during the (n−1)the intake stroke (i.e., during the period between the (n−1)th and (n−2)th predetermined crank angle); $AN_{(t)}$ is the output of the AFS (i.e., the amount of intake air which is sensed by the AFS at a predetermined crank angle of the engine); and $K_1$ and $K_2$ are coefficients of filteration for $AN_{(n-1)}$ and $AN_{(t)}$, respectively. Such control on fuel supply is to smoothe out the amount of intake air sucked into the engine cylinder on each intake stroke every time the engine takes a predetermined crank angle so as to effect proper control on fuel supply at all times especially at the time of rapid accelerations.

In the above-mentioned fuel control system, however, there is the following drawback. To modify the amount of intake air as sensed by the AFS necessarily creates a time lag in the calculation more than one intake stroke. Also, at the time of engine deceleration, there will be a time lag in the sensed output of the intake air sensor due to the presence of air in the intake pipe so that the amount of fuel supplied to the engine cylinder becomes excessive. Specifically, a portion of the fuel injected from a fuel injector adheres to the inner surface of the intake pipe and the remaining portion of the fuel is sucked into the engine cylinder. Accordingly, the amount of fuel forming an air/fuel mixture, which is to be sucked into the engine cylinder on a particular intake stroke, is the sum of a portion of fuel injected from the fuel injector on that intake stroke and a fuel which was previously supplied from the fuel injector on previous intake strokes and adhered to the inner surface of the intake pipe. In this connection, it is to be noted that the greater the engine load, the more is the amount of fuel supplied from the fuel injector so that the amount of fuel adhering to the intake pipe increases in proportion to the increasing engine load. In addition, the higher the number of revolutions per minute of the engine, the number of intake strokes per unit time increases so that the number of engine cycles having excessive fuel supply increases. Accordingly, the probability of excessive fuel supply becomes higher in accordance with an increase in the engine load and/or the number of revolutions per minute of the engine.

SUMMARY OF THE INVENTION

In view of the above, the present invention is intended to obviate the above-decribed problems and has for its object the provision of a system and a method for controlling fuel supply to an internal combustion engine in which excessive supply of fuel to the engine is effectively prevented in a most reliable manner particularly at the time of engine deceleration.

Bearing the above object in mind, the present invention resides in a system for controlling fuel supply to an internal combustion engine comprising:

first means for sensing a reduction in the amount of intake air sucked into an engine per intake stroke; and second means for reducing the amount of fuel supplied to the engine when the first means senses a reduction in the intake air amount.

Preferably, the system further comprises third means for changing the amount of reduction in the fuel supply in accordance with at least one of the number of revolutions per minute of the engine and the amount of intake air sucked into the engine per intake stroke.

According to another aspect, the present invention resides in a system for controlling fuel supply to an internal combustion engine comprising:

engine-revolution sensing means for sensing the number of revolutions per minute of an engine;

intake-air sensing means for sensing the amount of intake air sucked into the engine per intake stroke;

intake-air reduction sensing means for sensing a reduction in the amount of intake air sucked into the engine per intake stroke; and control means for reducing the amount of fuel supply to the engine in accordance with the reduced amount of intake air when the intake-air reduction sensing means senses a reduction in the intake air amount.

Preferably, the control means is operable to change the amount of reduction in the fuel supply in accordance with at least one of the number of revolutions per minute of the engine and the amount of intake air sucked into the engine per intake stroke.

It is preferred that the intake-air reduction sensing means be operable to determine a difference between the present amount of intake air sucked into the engine on the present intake stroke and the previous amount of intake air sucked into the engine on the previous intake stroke, the intake-air reduction sensing means being adapted to determine whether there is a reduction between the present amount of intake air and the previous amount of intake air.

According to a further aspect, the present invention resides in a method for controlling fuel supply to an internal combustion engine comprising the steps of:

sensing a reduction in the amount of intake air sucked into an engine per intake stroke; and reducing the amount of fuel supplied to the engine when a reduction in the intake air amount sucked into the engine is sensed.

Preferably, the method further comprises changing the amount of reduction in the fuel supply in accordance with at least one of the number of revolutions per minute of the engine and the amount of intake air sucked into the engine per intake stroke.

According to a still further aspect, the present invention resides in a method for controlling the fuel supply to an internal combustion engine comprising the steps of sensing the number of revolutions per minute of an engine;

sensing the amount of intake air sucked into the engine per intake stroke;

determining a difference between the present amount of intake air sucked into the engine on the present intake stroke and the previous amount of intake air sucked into the engine on the previous intake stroke, and further determining whether there is a reduction between the present amount of intake air and the previous amount of intake air; and reducing the amount of fuel supply to the engine in accordance with the reduced amount of intake air when there is a reduction between the present and previous amounts of intake air and changing the amount of reduction in the fuel supply in accordance with at least one of the number of revolutions per minute of the engine and the amount of intake air sucked into the engine per intake stroke.

The above and other objects, features and advantages of the present invention will become apparent from the following detailed description of a preferred embodiment thereof taken in conjunction with the accompanying drawings.

BRIEF DESCRIPTION OF THE DRAWINGS

FIG. 9 is a flowchart showing a second interrupt routine which is executed when an interrupt signal from a crank angle sensor is intput to the CPU.

DESCRIPTION OF THE PREFERRED EMBODIMENT

Now, the present invention will be described in detail with reference to a presently preferred embodiment as illustrated in the accompanying drawings.

Figure 3:
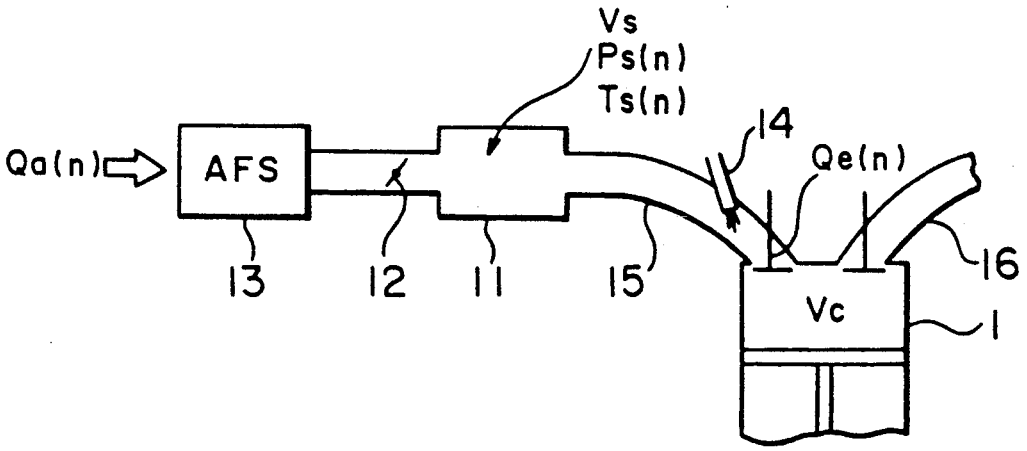
FIG. 3 is a schematic illustration of a typical model of an air intake system in an internal combustion engine.

Before describing in detail a concrete embodiment of the present invention, the basic principles of the invention will first be explained with reference to FIGS. 3 through 5. FIG. 3 illustrates a typical model of an intake system in an internal combustion engine to which the present invention is adapted to be applied. The engine includes a cylinder 1 having a displacement Vc per engine stroke. The intake system illustrated includes an intake pipe 15 connected with the engine cylinder 1, a surge tank 11 connected with the intake pipe 15, a throttle valve 12 disposed in the intake pipe 15 upstream of the surge tank 11, an air flow sensor (AFS) 13 in the form of a Karman vortex flow meter connected with the intake pipe 15 upstream of the throttle valve 12 for metering the intake air supplied to the engine cylinder 1 through the intake pipe 15, and a fuel injector 14 disposed in the intake pipe 15 at a location downstream of the surge tank 11 for injecting fuel into the intake pipe 15. An exhaust pipe 16 is connected with the engine cylinder 1 for dicharging combusted gases to the outside atmosphere. Here, it is assumed that the volume of that portion of the intake pipe 15 which is between the throttle valve 12 and the engine cylinder 1 be Vs.

Figure 4:
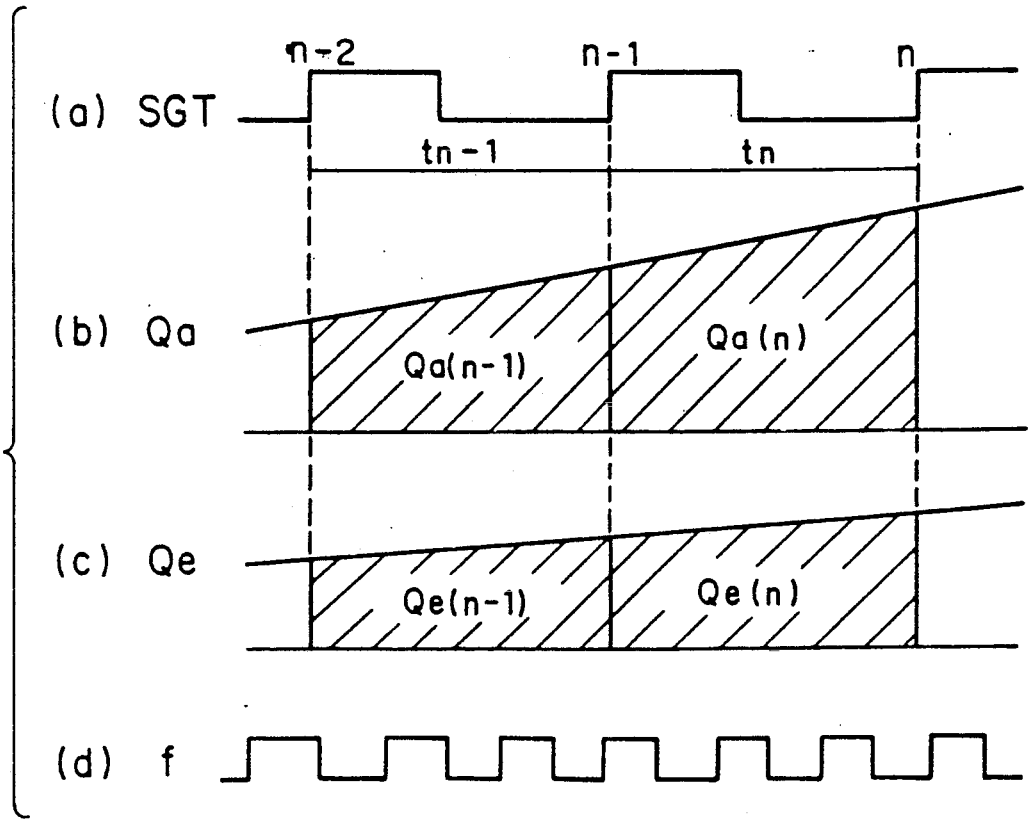
FIGS. 4(*a–d*) show the relationship between the amount of intake air sucked into the engine and the engine crank angle.

FIG. 4 shows the amount of intake air sucked into the engine cylinder 1 with relation to a predetermined crank angle wherein (a) represents a crank angle signal (hereinafter abbreviated as SGT) having rectangular-shaped pulses with rising edges each indicative of a predetermined crank angle; (b) the amount of intake air Qa which has passed the AFS 13; (c) the amount of intake air Qe actually sucked into the engine cylinder 1; and (d) the output pulse f of the AFS 13. Here, it is again assumed that the period of time between the (n−2)th rise and the (n−1)th rise of the SGT signal be $t_{n-1}$; the period of time between the (n−1)th rise and nth rise of the SGT signal be tn; the amounts of intake air passing through the AFS 13 during the periods of time $t_{(n-1)}$ and $t_n$ be $Q_{a(n-1)}$ and $Q_{a(n)}$, respectively; the amounts of intake air sucked into the engine cylinder 1 during the periods of time $t_{n-1}$ and $t_n$ be $Q_{e(n-1)}$ and $Q_{e(n)}$, respectively; the average pressures in the surge tank 11 during the periods of time $t_{n-1}$ and $t_n$ be $P_{s(n-1)}$ and $P_{s(n)}$, respectively; the average temperatures of intake air in the surge tank 11 during the periods of of time $t_{n-1}$ and $t_n$ be $T_{s(n-1)}$ and $T_{s(n)}$. In this connection, for example, $Q_{a(n-1)}$ corresponds to the number of output pulses of the AFS 13 during the time period $t_{n-1}$.

Here, if it is supposed that $T_{s(n-1)}$ be substantially equal to $T_{s(n)}$ and the charging efficiency of the engine cylinder 1 be constant, the following equations are obtained.

$$P_{s(n-1)} \cdot V_c = Q_{e(n-1)} \cdot R \cdot T_{s(n)} \quad (1)$$

$$P_{s(n)} \cdot V_c = Q_{e(n)} \cdot R \cdot T_{s(n)} \quad (2)$$

where R is a constant.

Also, if it is supposed that the amount of intake air staying in the surge tank 11 and the intake pipe 15 during the period tn be $\Delta Q_{a(n)}$, the following equation is obtained.

$$\begin{aligned} \Delta Q_{a(n)} &= Q_{a(n)} - Q_{e(n)} \\ &= V_s \cdot \frac{1}{R \cdot T_s} \times \{P_{s(n)} - P_{s(n-1)}\} \end{aligned} \quad (3)$$

From equations (1) through (3), the following equation is obtained.

$$Q_{e(n)} = \frac{1}{1 + \frac{V_c}{V_s}} \cdot Q_{e(n-1)} + \left(1 - \frac{1}{1 + \frac{V_c}{V_s}}\right) \cdot Q_{a(n)} \quad (4)$$

Accordingly, the amount of intake air $Q_{e(n)}$ sucked into the engine cylinder 1 during the time period $t_n$ can be calculated from equation (4) based on the amount of intake air $Q_{a(n)}$ passing through the AFS 13. Here, if Vc=0.5 l and Vs=2.5 l, the above equation (4) can be modified into the following equation.

$$Q_{e(n)} = 0.83 \times Q_{e(n-1)} = 0.17 \times Q_{a(n)} \quad (5)$$

Figure 5:
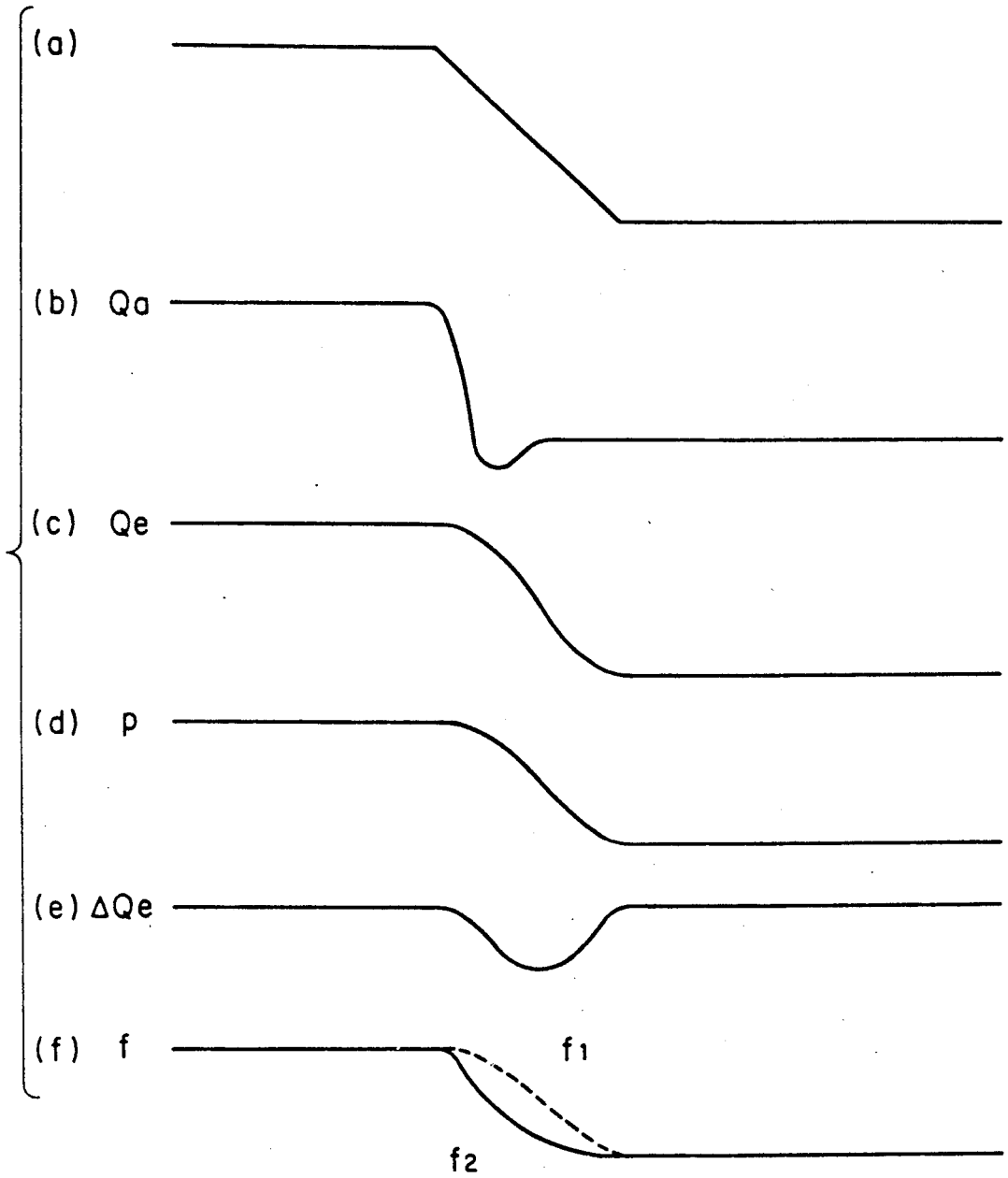
FIGS. 5(*a–f*) show a change in the amount of intake air sucked into the engine during a transition period of the engine.

FIG. 5 illustrates the situation of the engine in the case where the throttle valve 12 is closed. In this Figure, (a) represents the opening degree of the throttle valve 12; (b) the amount of intake air Qa passing through the AFS 13; (c) the amount of intake air Qe sucked into the engine cylinder 1 modified by using equation (4); (d) the pressure P in the surge tank 11; (e) the rate of change ΔQe of Qe; and (f) the amount of fuel supply f in which the broken line indicates the amount of fuel supply $f_1$ calculated based on Qe whereas the solid line indicates the amount of fuel supply $f_2$ which is obtained by modifying $f_1$ using ΔQe.

Figure 1:
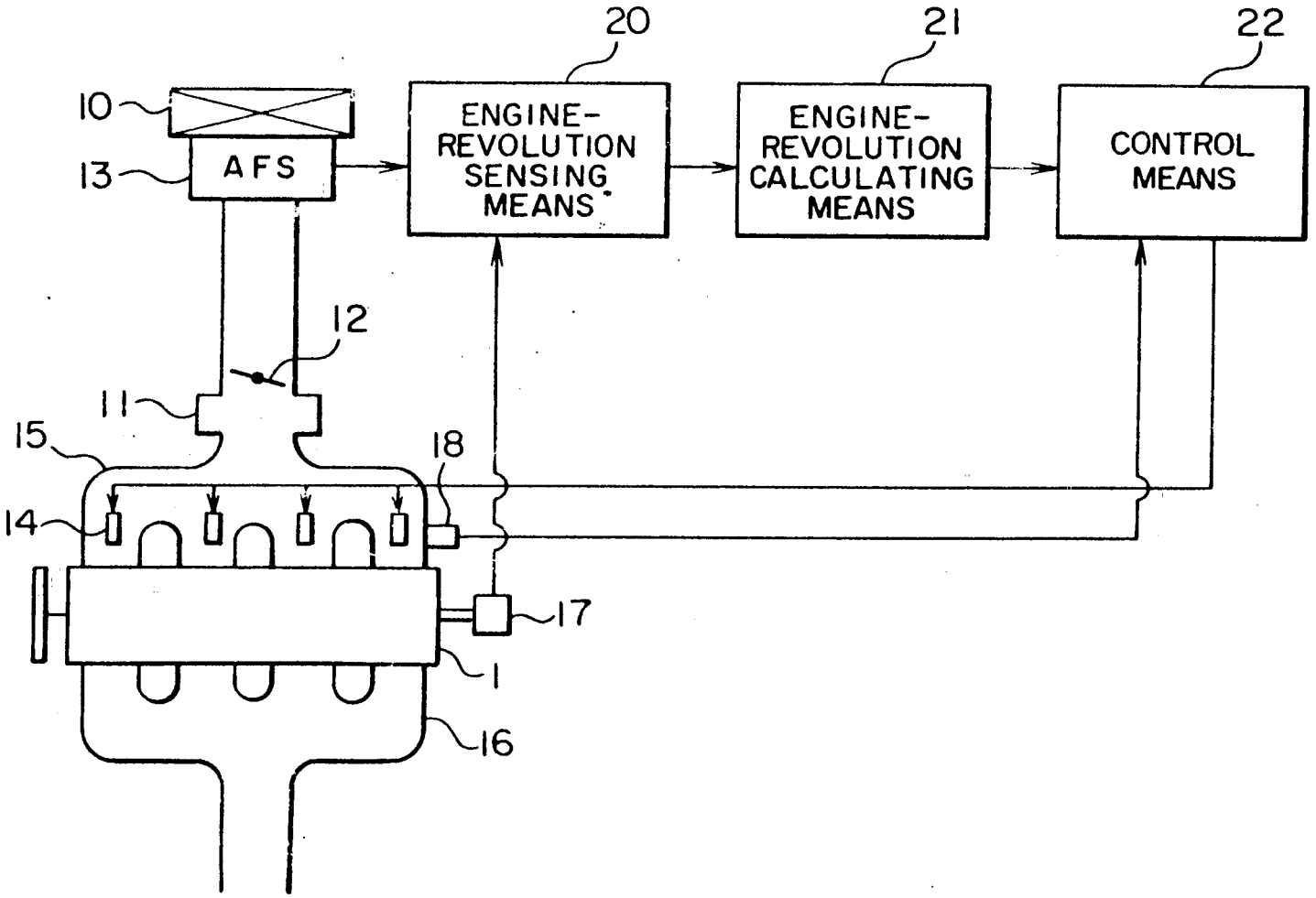
FIG. 1 is a schematic illustration showing the general construction of a fuel control system for an internal combustion engine in accordance with the present invention.

FIG. 1 schematically shows the general arrangement of an internal combustion engine equipped with a fuel control system in accordance with the present invention. In this Figure, the like or corresponding elements or portions of the engine are identified by the same reference numerals as those employed in FIG. 3. The engine illustrated includes an engine proper including a plurality of cylinders 1, an intake pipe 15 having an intake manifold connected with the cylinder 1, an air cleaner 10 connected with the outlet end of the intake pipe 15, a surge tank 11 connected with the intake pipe 15, and a throttle valve 12 disposed in the intake pipe 15 at a location just upstream of the surge tank 11, a plurality of fuel injectors 14 provided one for each cylinder 1 for supplying fuel thereto, and a temperature sensor 18 in the form of a thermister disposed adjacent the engine proper1 for sensing the temperature thereof (e.g., the temperature of engine coolant water), as is usual in this field of art. The fuel control system of the present invention includes an AFS 13 connected with the intake pipe at a location just downstream of the air cleaner 10 for sensing the amount of intake air sucked into the engine proper 1 per intake stroke to output a pulse the length of which is dependent on the sensed intake air amount, as shown by (d) in FIG. 4, a crank angle sensor 17 operatively connected with the engine proper 1 (e.g., an unillustrated engine crankshaft) for generating a pulsated signal which has, for example, rectangular-shaped pulses with their two consecutive rising edges being spaced from each other a crank angle of 180, as shown by (a) in FIG. 4, an engine-revolution sensing means 20 operatively connected to receive the output of the AFS 13 and the output of the crank angle sensor 17 for counting the number of output pulses of the AFS 13 which are issued during a predetermined crank angle of the engine proper 1, an engine-revolution calculating means 21 operatively connected to receive the output of the engine-revolution sensing means 20 for calculating the number of pulses of the AFS 13 corresponding to the amount of intake air actually sucked into the engine proper 1 by using the aforementioned formula (5), and a control means 22 operatively connected to receive the output of the engine-revolution calculating means 21 and the output of the temperature sensor 18 for controlling the length of drive time of the fuel injector 14 so as to adjust the fuel supply to the engine proper 1.

Figure 2:
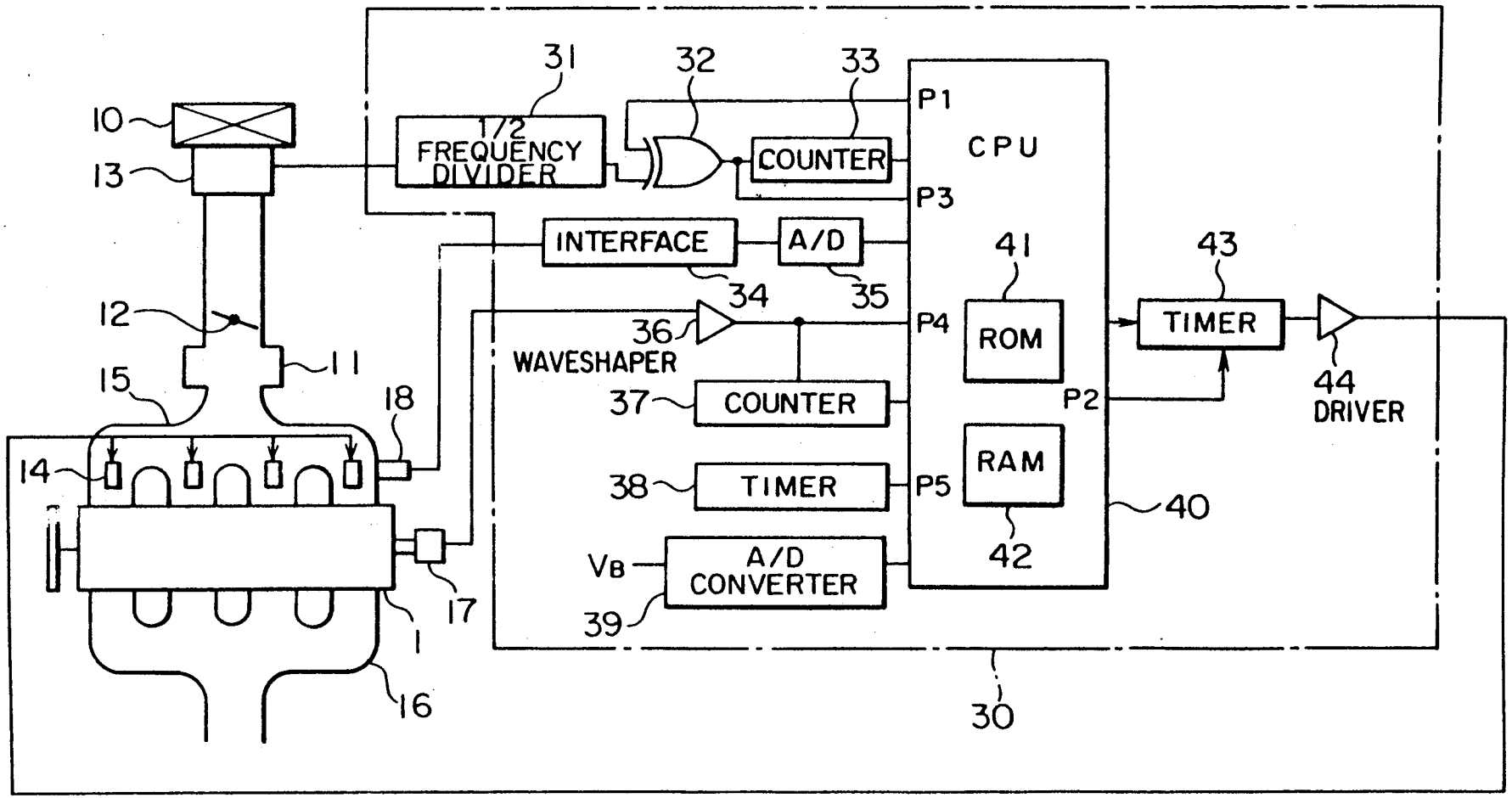
FIG. 2 is a schematic illustration showing a preferred embodiment of the fuel control system in accordance with the present invention.

FIG. 2 shows a more concrete structure of the fuel control system as illustrated in FIG. 1. In FIG. 2, the fuel control system comprises a controller 30 in the form of a microcomputer which corresponds to the engine-revolution sensing means 20, the engine-revolution calculating means 21 and the control means 22 and which is operatively connected to receive the outputs of the AFS 13, the temperature sensor 18 and the crank angle sensor 17 for controlling the operations of the repective fuel injectors 14 provided one for each engine cylinders. Specifically, the controller 30 comprises, for example, a CPU 40 including a ROM 41 and a RAM 42. A frequency divider 31 is operatively connected to receive the output of the AFS 13 for dividing the output of the AFS 13 into halves. An exclusive OR gate 32 is operatively connected at one of its two input terminals with the output terminal of the frequency divider 31 and at its other input terminal with a first output port P1 of the CPU 40. The exclusive OR gate 32 has an output terminal operatively connected with a counter 33 and a first interrupt input port P3 of the CPU 40. A waveform shaper 36 is connected at its input terminal with the output terminal of the crank angle sensor 17 and at its output terminal with a second interrupt input port P4 of the CPU 40 and an input terminal of a counter 37. A timer 38 is connected with a third interrupt input port P5 of the CPU 40. An A/D converter 35 is connected at its input terminal with the temperature sensor 18 through an interface 34 and at its output terminal with the CPU 40 for effecting an A/D conversion of the voltage supplied by an unillustrated battery and then supplying the A/D converted voltage to the CPU 40. The CPU 40 is connected at its output terminal through a timer 43 with a driver 44 which has an output terminal connected with the respective fuel injectors 14.

Now, the operation of the above-mentioned embodiment will be described. The output of the AFS 13 is frequency divided by the frequency divider 31 and then input to the counter 33 through the exclusive OR gate 32 which is controlled by the CPU 40. The counter 33 is operable to count during a period of time between two consecutive falling edges of the output of the gate 32. Each fall of the output signal of the gate 32 is input to the first interrupt input port P3 of the CPU 40 whereupon the CPU 40 executes an interrupt processing once a period or a half period of output pulses of the AFS 13 so as to measure the period of the counter 33. The output of the temperature sensor 18 is converted by the interface 34 into a voltage which is in turn converted by the A/D converter 35 into a digital value every predetermined period of time and then input to the CPU 40. The output of the crank angle sensor 17 is input through the waveform shaper 36 to the second interrupt input port P4 of the CPU 40 and the counter 37. The CPU 40 operates to execute interrupt processing every rise of the output of the crank angle sensor 17 so as to measure from the output of the counter 37 a period between two consecutive rises of the crank angle sensor output. The timer 38 sends out an interrupt signal to the third interrupt input port P5 of the CPU 40 every predetermined period of time. The A/D converter 39 operates to perform a analog to digital conversion of the output voltage of an unillustrated battery so that the CPU 40 takes in the data of the A/D converted voltage of the battery every predetermined time. The timer 43 is preset by the CPU 40 and triggered by the output signal from the output port P2 of the CPU 40 to output a pulse signal of a predetermined pulse width to the driver 44 whereby the driver 44 is in turn operated to drive the respective fuel injectors 14.

Figure 6:
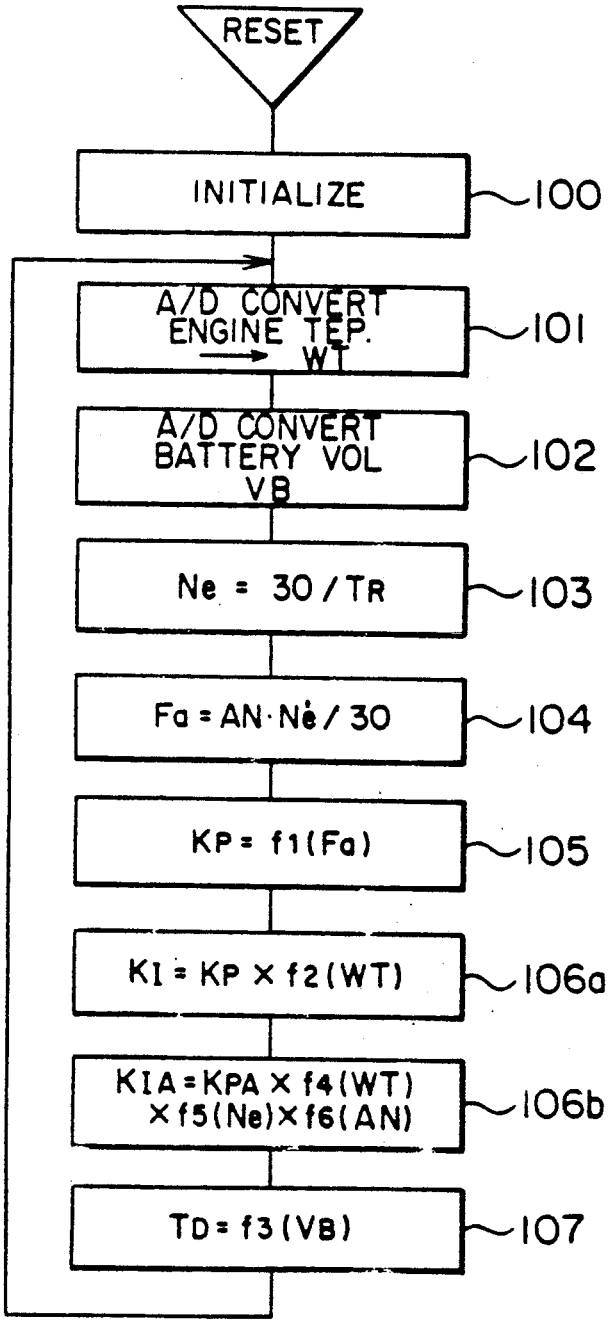
FIG. 6 is a flowchart showing a main routine for controlling the operation of the fuel control system of FIG. 2.
Figure 7:
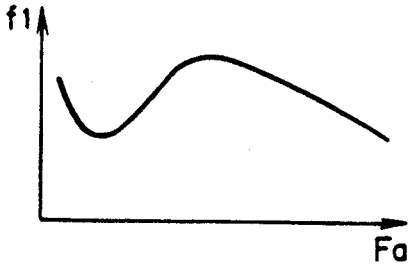
FIGS. 7(*a*) through 7(*d*) are graphic representations showing changes in the coefficient of modification due to the temperature, the number of revolutions per minute of the engine, and the engine load.
Figure 7:
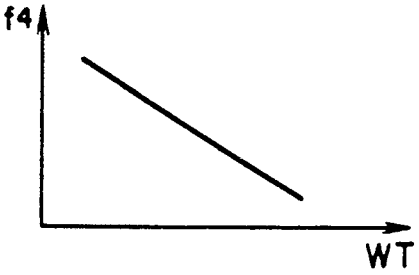
Figure 7:
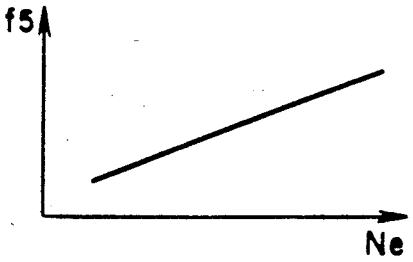
Figure 7:
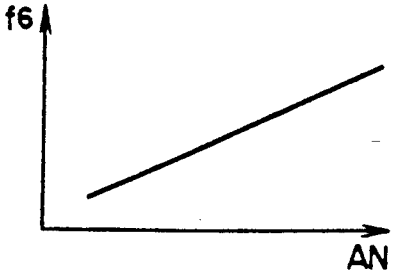

Next, the operation of the CPU 40 will be described with reference to flowcharts illustrated in FIGS. 6, 8 and 9. First, FIG. 6 shows a main program which is to be executed by the CPU 40. When a reset signal is input to the CPU 40, the RAM 42 and all the input and output ports of the CPU 40 are initialized in Step 100. Then in Step 101, the analog output of the temperature sensor 18 is converted by the A/D converter 39 into a digital value which is stored as WT in the RAM 42. In Step 102, the battery voltage is A/D converted by the A/D converter 39 and stored as VB in the RAM 42. Subsequently in Step 103, based on the period $T_R$ of the crank angle sensor 17, $30/T_R$ is calculated so as to obtain the number of revolutions per minute Ne of the engine proper 1. In Step 104, based on a load data AN to be described later and the number of revolutions per minute Ne of the engine, there is calculated AN·Ne/30 from which the output frequency Fa of the AFS 13 is determined. Then in Step 105, from the AFS output frequency Fa thus determined and $f_1$ which is preset for Fa in the manner as shown in FIG. 7(*a*), a basic drive time modification coefficient $K_P$ is calculated which is then modified by the temperature data WT into a first drive time modification coefficient $K_I$ which is stored in the RAM 42 in Step 106*a*. In Step 106*b*, an acceleration-period basic drive time modification coefficient $K_{PA}$ during an acceleration period in which fuel supply is increased is modified by the temperature data WT, the number of revolutions per minute Ne of the engine and the engine load data AN into a second drive time modification coefficient $K_{IA}$ which is stored in the RAM 42. FIGS. 7(*b*) through (*d*) show changes of these modification coefficients. As is clear from these Figures, the lower the engine temperature, the more the amount of fuel to adhere to the interior surface of the intake pipe 15 becomes so that an accordingly greater amount of fuel is needed. On the other hand, at high engine temperatures, the amount of fuel adhering to the interior surface of the intake pipe 15 becomes less so that a smaller amount of fuel supply is required. Also, the amount of fuel supply is controlled to change in proportion to the number of revolutions per minute of the engine and the engine load.

Subsequently, in Step 107, a data table $f_3$ which was formed from the battery data VB and previously stored in the ROM 41 is mapped so as to find a dead time $T_D$ which is then stored in the RAM 42. After Step 107, the main control program returns to Step 101.

Figure 8:
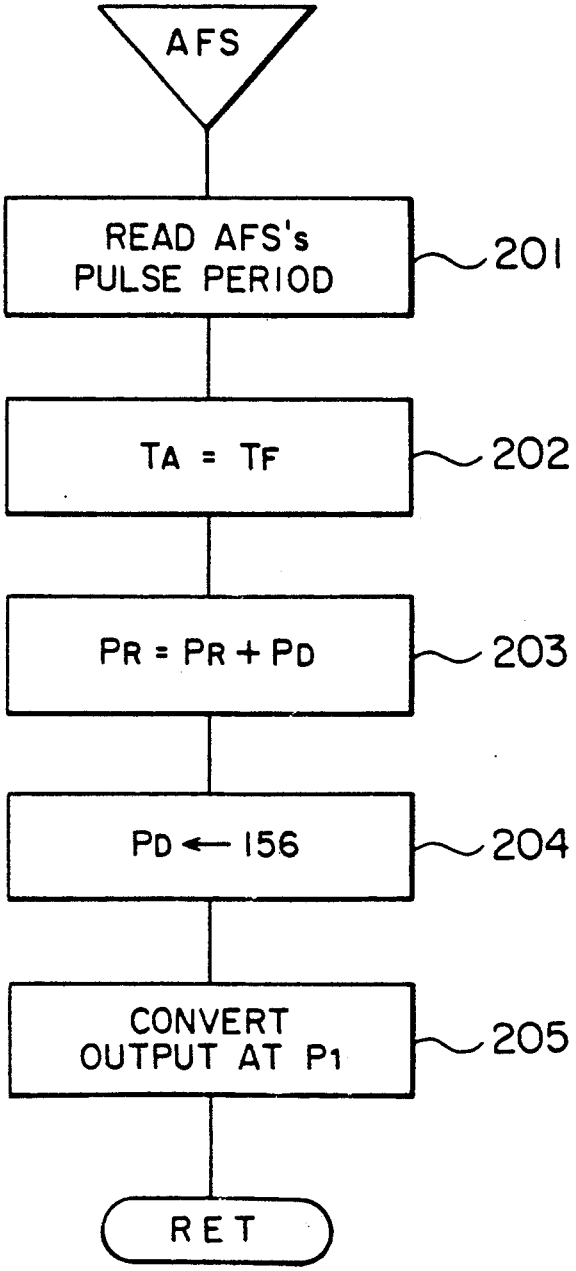
FIG. 8 is a flowchart showing a first interrupt routine which is executed when an interrupt signal from an AFS is input to an interrupt input port of a CPU.

FIG. 8 shows a first interrupt routine which is executed when the output of the AFS 13 is input to the first interrupt input port P3 of the CPU 40. As illustrated in FIG. 8, in Step 201, when the counter 33 generates an output $T_F$ which is fed to and detected by the CPU 40, the counter 33 is cleared. The counter output $T_F$ thus detected is a rise period of the gate 32 between two consecutive rises thereof. In Step 202, the period $T_F$ is stored in the RAM 42 as an output pulse period $T_A$ and in Step 203 a remaining pulse data $P_D$ is added to a multiplication pulse data $P_R$. In Step 204, the remaining pulse data $P_D$ is set as 156 and in Step 205 the output at the port P1 of the CPU 40 is inverted to reset the counter 33. After Step 205, the interrupt routine finishes.

FIG. 9 shows a second interrupt routine which is executed when the output of the crank angle sensor 17 is input to the second interrupt input port P4 of the CPU 40. In Step 301, a rise period of the crank angle sensor 17 is read from the counter 37 and stored as a period $T_R$ in the RAM 42. Thereafter, the counter 37 is cleared. In Step 302, if there is an output pulse from the AFS 13 within the period $T_R$, a difference ($\Delta t = t_{o\,2} - t_{o\,1}$) between the present interrupt time $t_{o\,2}$ when the present output pulse of the AFS 13 is issued and the last or previous interrupt time $t_{o\,1}$ when the last output pulse of the AFS 13 was issued is calculated as a period Ts. If there is no output pulse of the AFS 13 within the period $T_R$, the period $T_R$ is replaced with the period Ts. In Step 305, the time difference $\Delta t$ is converted into an output pulse data $\Delta P$ of the AFS 13 by using a formula ($156 \times Ts/T_A$). In other words, the pulse data $\Delta P$ is calculated with the assumption that the present output pulse period of the AFS 13 be equal to the previous output pulse period of the AFS 13. In Step 306, the pulse data $\Delta P$ thus calculated is compared with the value 156 and if $\Delta P \leqq 156$, the program proceeds to Step 308 where the remaining pulse data $P_D$ is subtracted by the pulse data $\Delta P$ to provide a new remaining pulse data $P_D$. On th ther hand, if it is determined $\Delta P > 156$ in Step 306, the program proceeds to Step 307 where $\Delta P$ is clipped as 156. In Step 309, if the new remaining pulse data $P_D$ is positive, the program proceeds to Step 313*a* but if otherwise, it is determined that the newly calculated value of the pulse data $\Delta P$ is greater than the output pulse of the AFS 13 and the program proceeds to Step 310 where the pulse data $\Delta P$ is made equal to $P_D$ and then in Step 312 the remaining pulse data is made to zero. In Step 313, the multipication pulse data $P_R$ is added by the pulse data $\Delta P$ to provide a new multipication pulse data $P_R$ which is considered to correspond to the number of pulses which are output by the AFS 13 between the present and last rises of the AFS output. In Step 314, the aforementioned equation (5) is calculated. Namely, based on the engine load data AN and the multiplication pulse data $P_R$ which were already calculated by the last rise of the output of the crank angle sensor 17, the formula $K_1\,AN + (K_2)P_R$ is calculated and the result thus obtained is made to be a new engine load data AN. In Step 315, this new engine load data AN is compared with a predetermined value $\alpha$. If it is determined $AN > \alpha$, the engine load data AN is clipped as $\alpha$ in Step 316 so as to prevent the load data AN from becoming too greater than the actual engine load even at the time of the throttle valve 12 being fully opened. In Step 317, the multiplication pulse data $P_R$ is cleared. In Step 318*a* the drive time data $T_1$ is calculated from the load data AN, the drive time modification coefficient $K_1$ and the dead time $T_D$ by using the formula ($T_1 = AN \cdot K_1 + T_D$). In Step 318*b*, a difference ΔAN between the new engine load data AN and the last engine load data $AN_{old}$ is calculated and then in Step 318*c*, it is determined whether ΔAN is less than a first reference value $-\beta$ 1. If $\Delta AN \geqq -\beta$ 1, the program proceeds to Step 318*g*. On the other hand, if $\Delta AN < -\beta$ 1, the program proceeds to Step 318*d* where it is further determined whether ΔAN is less than a second reference value $-\beta$ 2. If $\Delta AN \geqq -\beta$ 2, the program proceeds to Step 318*f* but if $\Delta AN < -\beta$ 2, the program proceeds to Step 318*e* where ΔAN is clipped as $-\beta$ 2 and then the program proceeds to Step 318*f*. In Step 318*f*, a new drive time data $T_1$ is calculated from the last $T_1$, ΔAN and $K_{IA}$. In Step 318*g*, $AN_{old}$ is updated as AN which is then stored in the RAM 42. Subsequently in Step 319, the new drive time data $T_1$ is set into the timer 43 and in Step 320, the timer 43 is triggered to simultaneously drive all the injectors 14 for a newly set drive time. Thus, the processing of the second interrupt routine finishes.

Figure 10:
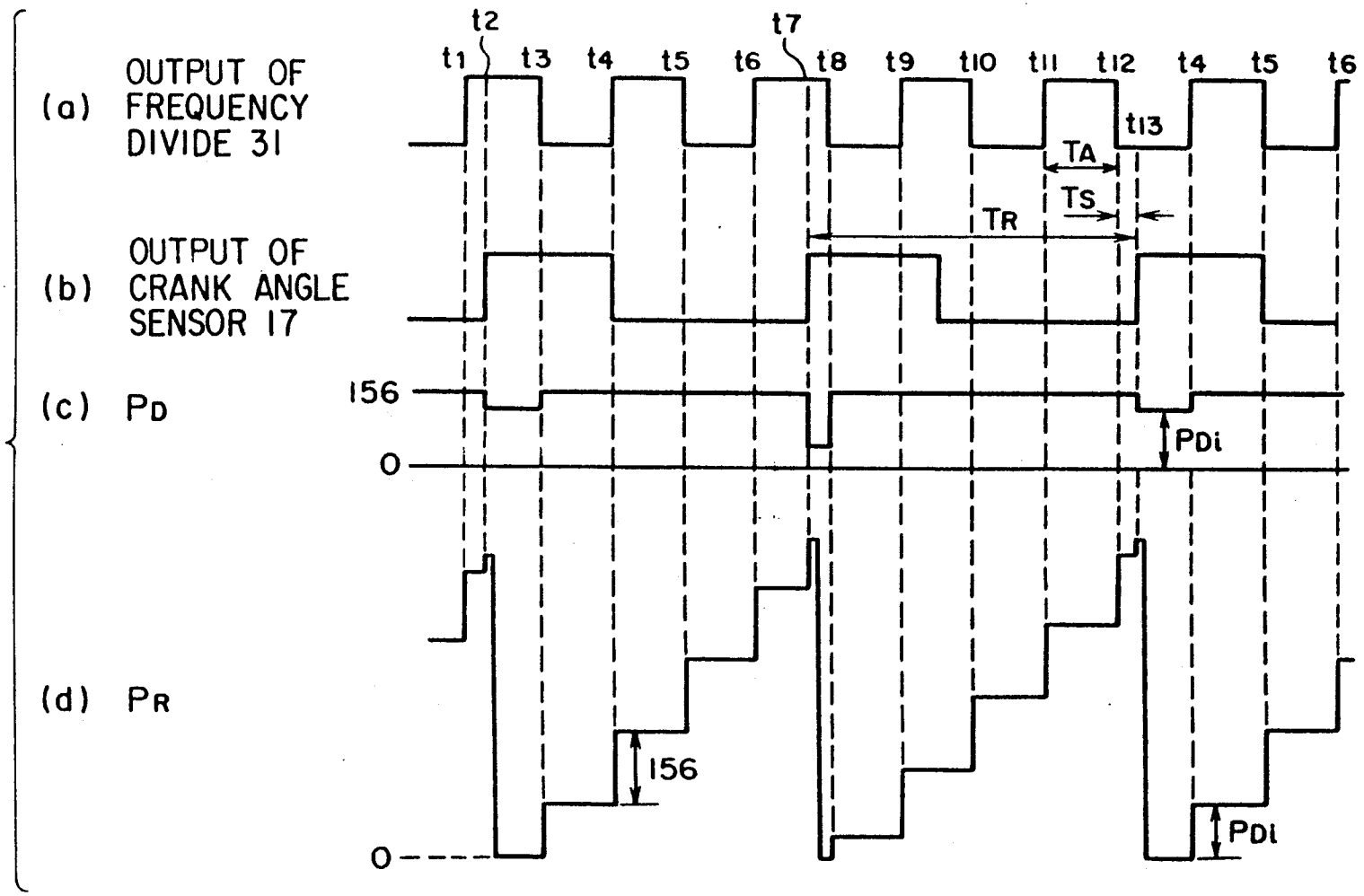
FIGS. 10(*a–d*) are a timing chart showing the timing relations between the output of a frequency divider, the output of the crank angle sensor, a remaining pulse data and a multiplication pulse data.

FIG. 10 shows timings at which frequency dividing flags are cleared during the processings of FIGS. 6, 8 and 9. In FIG. 10, (a) represents the output of the frequency divider 31 and (b) the output of the crank angle sensor 17; (c) represents the remaining pulse data $P_D$ which is set as 156 upon each rise and fall of the output signal from the frequency divider 31 (i.e., upon each rise and fall of the output of the AFS 13), the remaining pulse data being further updated, for example, as ($P_{Di} = P_D - 156 \times Ts/T_A$) upon every rise of the output of the crank angle sensor 17 (this corresponds to the processings in Steps 305 through 312); and (d) represents a change in the multiplication pulse data $P_R$, showing that the remaining pulse data $P_D$ is calculated through multiplication upon every rise or fall of the output of the frequency divider 31.

Although in the above-decribed embodiment, the number of output pulses of the AFS 13 during two consecutive rises of the output pulses of the crank angle sensor 17 is counted, such counting may instead be effected between two consecutive falls. Also, the number of output pulses of the AFS 13 during several periods of the crank angle sensor 17 may be counted for the same purpose. Further, in place of counting the AFS's output pulses, the number of AFS's output pulses multiplied by a coefficient corresponding to the AFS's output frequency may be counted. Moreover, instead of using the crank angle sensor 17, firing signals of the engine can be utilized in order to detect the engine crank angle with the same results.

As will be apparent from the foregoing, the present invention provides the following advantages. According to the present invention, a reduction in the amount of intake air per intake stroke during deceleration of the engine is detected so that the amount of fuel supply to the engine is accordingly decreased. As a result, it is possible to supply a correct and proper amount of fuel to the engine at all times particularly at the time of engine deceleration, thus effectively preventing excessive supply of fuel which would otherwise be caused due to delays in the calculation of intake air amount carried out each intake stroke and/or in the operation of the fuel control system. Further, such an amount of reduction in the fuel supply is varied in response to the number of revolutions per minute of the engine and/or the engine load so that proper control on the air to fuel ratio of a mixture can always be performed even in the high-revolution and high-load operating ranges of the engine in which fuel supply tends to become overrich.

What is claimed is:

1. A system for controlling fuel supply to an internal combustion engine comprising:

first means for sensing a reduction in the amount of intake air sucked into an engine per intake stroke;

second means for reducing the amount of fuel supplied to the engine when said first means senses a reduction in the intake air amount, said second means controlling the time of fuel supply $T_{I(n)}$ based on the following formula, $$T_{I(n)} = T_{I(n-1)} + \Delta AN \times K_{IA},$$

where $T_{I(n)}$ is the time of the present fuel supply, $T_{I(n-1)}$ is the time of the last fuel supply, ΔAN is the difference between the present engine load and the last engine load, and $K_{IA}$ is a modification coefficient; and third means for changing the modification coefficient $K_{IA}$ in the above formula in accordance with at least one of the number of revolutions per minute of the engine and the amount of intake air sucked into the engine per intake stroke.

2. A system for controlling fuel supply to an internal combustion engine comprising:

engine-revolution sensing means for sensing the number of revolutions per minute of an engine;

intake air sensing means for sensing the amount of intake air sucked into the engine per intake stroke;

intake-air reduction sensing means for sensing a reduction in the amount of intake air sucked into the engine per intake stroke; and control means for reducing the amount of fuel supply to the engine in accordance with the reduced amount of intake air when said intake-air reduction sensing means senses a reduction in the intake air amount by controlling the time of fuel supply $T_{I(n)}$ based on the following formula, $$T_{I(n)} = T_{I(n-1)} + \Delta AN \times K_{IA},$$

where $T_{I(n)}$ is the time of the present fuel supply, $T_{I(n-1)}$ is the time of the last fuel supply, ΔAN is the difference between the present engine load and the last engine load, and $K_{IA}$ is a modification coefficient; and wherein said control means is operable to change the modification coefficient $K_{IA}$ in the above formula in accordance with at least one of the number of revolutions per minute of the engine and the amount of intake air sucked into the engine per intake stroke.

3. A system for controlling fuel supply to an internal combustion engine as claimed in claim 2, wherein said intake-air reduction sensing means is operable to determine a difference between the present amount of intake air sucked into the engine on the present intake stroke and the previous amount of intake air sucked into the engine on the previous intake stroke, said intake-air reduction sensing means being adapted to determine whether there is a reduction between the present amount of intake air and the previous amount of intake air.

4. A method for controlling fuel supply to an internal combustion engine comprising the steps of:

sensing a reduction in the amount of intake air sucked into an engine per intake stroke;

reducing the amount of fuel supplied to the engine when a reduction in the intake air amount sucked into the engine is sensed, by controlling the time of fuel supply $T_{I(n)}$ based on the following formula, $$T_{I(n)}=T_{I(n-1)}+\Delta AN\times K_{IA},$$

where $T_{I(n)}$ is the time of the present fuel supply, $T_{I(n-1)}$ is the time of the last fuel supply, $\Delta AN$ is the difference between the present engine load and the last engine load, and $K_{IA}$ is a modification coefficient; and changing the modification coefficient $K_{IA}$ in the above formula in accordance with at least one of the number of revolutions per minute of the engine and the amount of intake air sucked into the engine per intake stroke.

5. A method for controlling fuel supply to an internal combustion engine comprising the steps of:

sensing the number of revolutions per minute of an engine;

sensing the amount of intake air sucked into the engine per intake stroke;

determining a difference between the present amount of intake air sucked into the engine on the present intake stroke and the previous amount of intake air sucked into the engine on the previous intake stroke, and further determinging whether there is a reduction between the present amount of intake air and the previous amount of intake air; and reducing the amount of fuel supply to the engine in accordance with the reduced amount of intake air when there is a reduction between the present and previous amounts of intake air by controlling the time of fuel supply $T_{I(n)}$ based on the following formula, $T_{I(n)}=T_{I(n-1)}+\Delta AN\times K_{IA}$, where $T_{I(n)}$ is the time of the present fuel supply, $T_{I(n-1)}$ is the time of the last fuel supply, $\Delta AN$ is the difference between the present engine load and the last engine load, and $K_{IA}$ is a modification coefficient and changing the modification coefficient $K_{IA}$ in the above formula in accordance with at least one of the number of revolutions per minute of the engine and the amount of intake air sucked into the engine per intake stroke.

* * * * *